US005722255A

United States Patent [19]

Brasz

[11] Patent Number: 5,722,255

[45] Date of Patent: Mar. 3, 1998

[54] LIQUID RING FLASH EXPANDER

[76] Inventor: Joost J. Brasz, 1 Landgrove Dr., Fayetteville, N.Y. 13066

[21] Appl. No.: 753,965

[22] Filed: Dec. 4, 1996

[51] Int. Cl.[6] ..... F17C 9/04; F25B 1/00

[52] U.S. Cl. ..... 62/498; 62/50.3; 62/116

[58] Field of Search ..... 418/15; 62/116, 62/498, 50.3, 402

[56] References Cited

U.S. PATENT DOCUMENTS

| | | | |
|---|---|---|---|
| 4,235,079 | 11/1980 | Masser | 62/116 |
| 5,347,829 | 9/1994 | Alsenz | 62/116 |
| 5,636,523 | 6/1997 | Assaf | 62/402 |

*Primary Examiner*—William E. Wayner

[57] ABSTRACT

A vaned rotor is eccentrically located within a casing defining a cylindrical chamber. Adjacent vanes of the rotor coact with the casing to define cells. Saturated or slightly subcooled liquid refrigerant is supplied to each passing cell of the rotating rotor. The refrigerant in the cells is subjected to centrifugal forces creating a pressure gradient causing flashing of gaseous refrigerant and the cooling of the liquid refrigerant. The cell rotates into registration with ports permitting the flow of cooled liquid refrigerant to the evaporator and gaseous refrigerant to the evaporator or to the compressor as suction gas or economizer gas.

8 Claims, 4 Drawing Sheets

LIQUID RING FLASH EXPANDER

BACKGROUND OF THE INVENTION

In a typical refrigeration system, the high pressure liquid refrigerant flow leaving the condenser is normally flashed through a throttling device to a lower pressure resulting in a two-phase flow mixture entering the evaporator. The largest irreversibility of the vapor compression cycle is this throttling loss. Replacing this adiabatic throttling process with a power recovering expansion process approaching isentropic expansion will substantially increase overall cycle efficiency of the refrigeration/air conditioning system. It will also increase the cooling capacity of the system at the same compressor flow rates. The major obstacle to realizing this energy saving potential is the highly turbulent, flashing liquid, two-phase flow pattern occurring during expansion which does not easily allow efficient power recovery. Although the two-phase flow expanders/turbines have been recognized in theory as a potential efficiency improvement to the vapor compression cycle, commercial realization of power recovery from flashing liquids has been limited to special bi-phase turbomachinery equipment which is limited to larger capacity HVAC equipment.

SUMMARY OF THE INVENTION

The current invention of the liquid ring expander extends the possibility of power recovery of flashing liquids to lower capacities than can be done economically with turbo-expanders. Also, the liquid ring expander can be easily modified to accommodate power recovery for economizer cycle arrangements with a multi-step pressure drop between condenser and evaporator by appropriately positioning an additional vapor discharge port. In this case the liquid ring flash expander has the additional benefit of acting as a flow separator separating the liquid refrigerant from the vapor refrigerant due to centrifugal action and thus eliminating the need for a separate economizer vessel.

A liquid ring flash expander is provided and has a vaned rotor eccentrically mounted in and coacting with a casing to define a plurality of circumferentially spaced recesses with the vanes having a variable radial gap with the casing. The gap between the rotor vanes and the casing is sealed by a concentrically running liquid ring. Due to the differences in density between refrigerant vapor and liquid the thickness of the liquid layer rotating in the casing of the expander will be more or less constant around the circumference. The rotation of the liquid sets up a radial pressure gradient in the liquid ring with the lower pressures occurring at the smaller radii, i.e. nearest the axis of rotation. When saturated or slightly subcooled liquid refrigerant, as from the condenser of a refrigeration system, is supplied to the expander at a location radially inward of the tips of the rotor vanes and where the tips approach the casing, the liquid refrigerant will flash at these smaller radii between adjacent vanes where the pressure becomes less than the saturation pressure due to the effects of centrifugal forces tending to force the liquid radially outward. The flashing or expansion of the refrigerant provides the motive force for rotating the vaned rotor. As a result, the cell formed by the liquid ring, the two neighboring rotor blades and the casing becomes partly filled with vapor. During 180° of rotation from where the tips of the adjacent vanes are nearest to the casing to the point where they are furthest from the casing, the cell becomes larger in volume due to the eccentricity of the rotor, thus allowing further expansion of the vapor to a lower pressure level and farther flash evaporation of the liquid in the ring. When the maximum expansion has occurred, the cell is in communication with two radially spaced ports such that the expanded refrigerant will exit the cell via a port near the center of the casing while the liquid refrigerant cooled by the flash evaporation will exit the cell via a port located at a point intermediate the center and the outside of the casing. The cooled liquid refrigerant exiting the cell is supplied to the evaporator of the refrigeration system. The gaseous refrigerant exiting the cell can be supplied to the evaporator or may be supplied to the compressor at an intermediate pressure as economizer gas.

In an air conditioning or refrigeration system, the liquid ring flash expander of the present invention can have several applications. In a simple refrigeration cycle, it can be used as a two phase flow expander, boosting system efficiency and capacity by simultaneously increasing the refrigeration effect and reducing the required input power. In a refrigeration system with an economizer cycle, the present invention could be used to replace the economizer vessel since it separates the vapor from the liquid refrigerant due to centrifugal action. Multiple ports at different circumferential positions may be used to permit the extracting of refrigerant vapor at different intermediate pressure levels thus allowing multi-stage economizer cycle operation.

The liquid ring flash expander of the present invention is inherently a power recovery device since it is driven by the expansion/flashing of the gas. Additionally, the liquid ring flash expander does not require a throttle valve between the condenser and expander since the expander recovers the expansion power of the flashing refrigerant.

It is an object of this invention is to improve cycle efficiency by recovering expansion losses.

It is another object of this invention to eliminate the need for a separate vessel for an economizer cycle.

It is a further object of this invention to allow multi-stage economizer cycle operation. These objects, and others as will become apparent hereinafter, are accomplished by the present invention.

Basically, saturated or slightly subcooled liquid refrigerant is supplied to a cell defined by adjacent vanes of the eccentric rotor, the liquid ring and the casing. As the rotor rotates, the refrigerant is subjected to a radial pressure gradient resulting in flashing with phase separation taking place due to centrifugal forces acting on the liquid refrigerant. As the cell rotates it communicates with one or more gas ports and a liquid port whereby gaseous and liquid refrigerant exit separately from the cell.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 2:
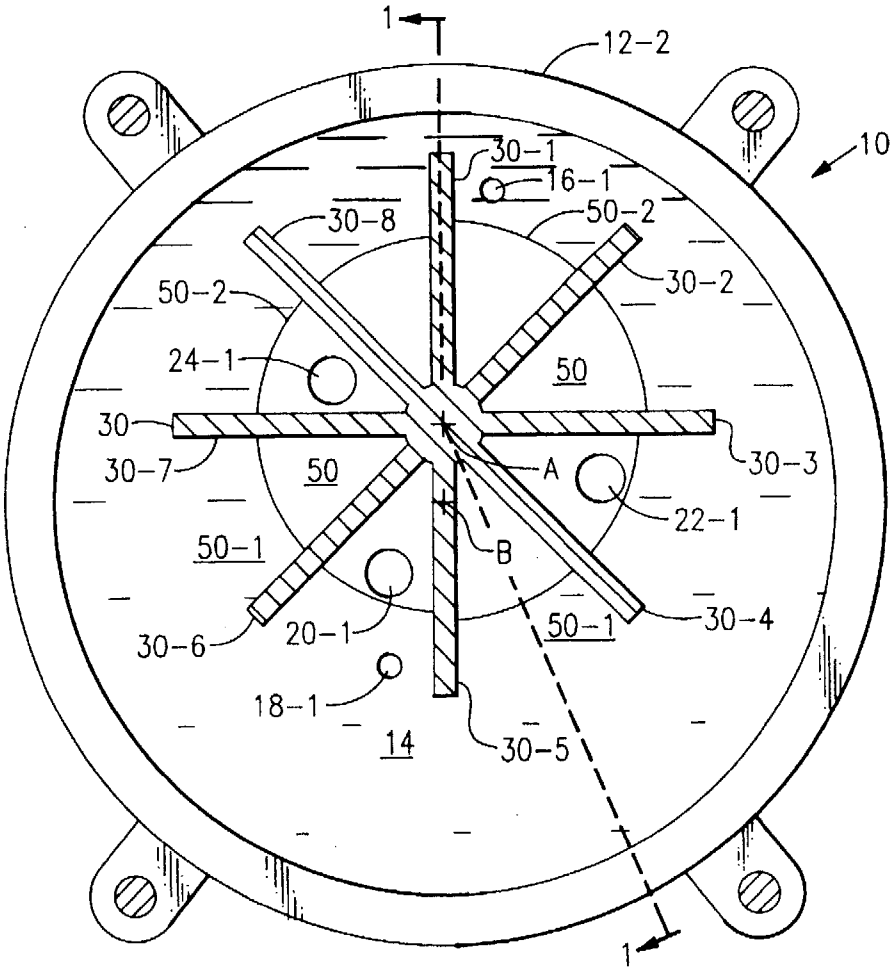
FIG. 2 is a sectional view taken along line 2—2 of FIG. 1.
Figure 1:
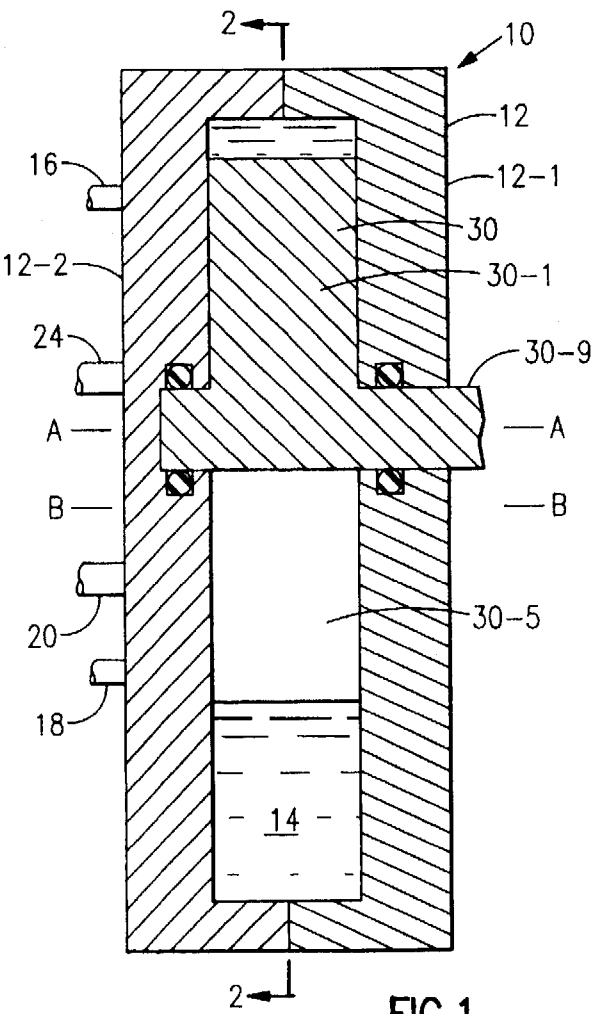
FIG. 1 is a sectional view of the liquid ring flash expander of the present invention taken along line 1—1 of FIG. 2.
Figure 3:
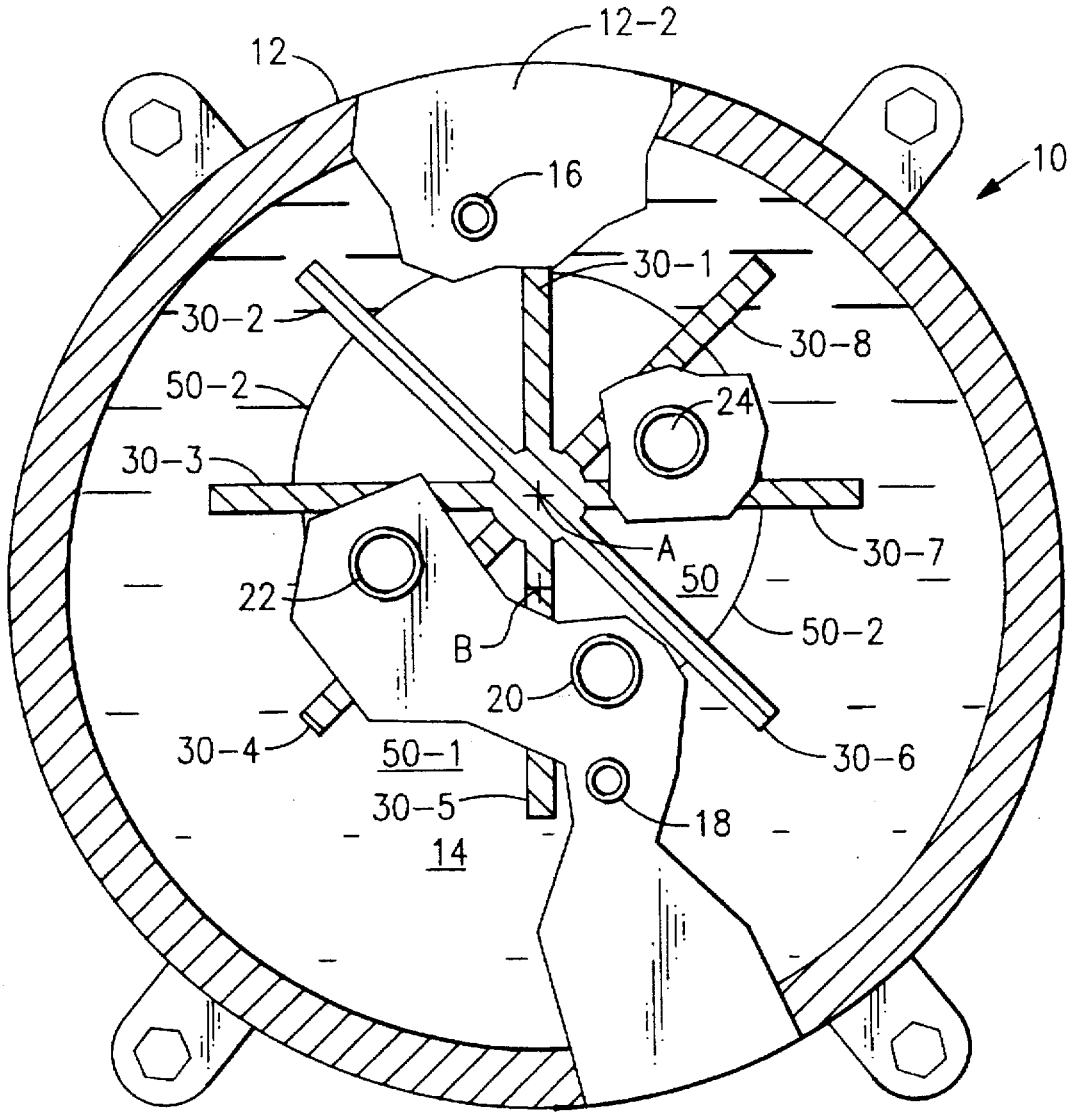
FIG. 3 is a partially cutaway end view of the structure of FIG. 2.
Figure 4:
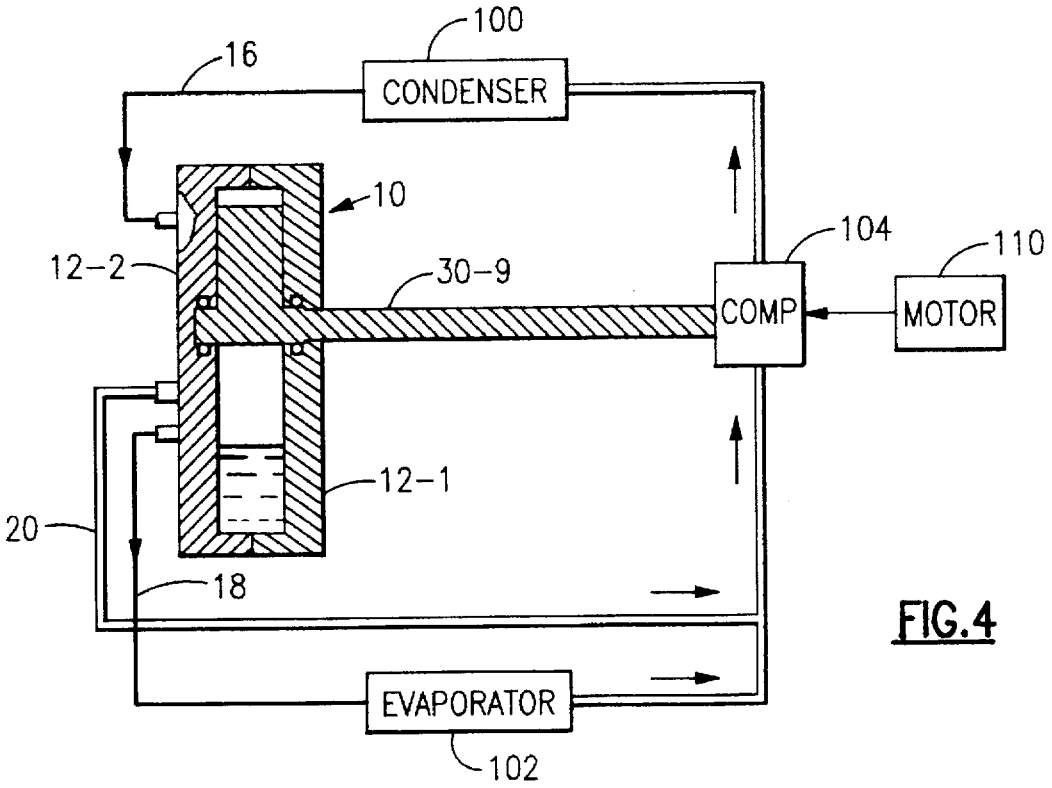
FIG. 4 is a schematic view of a refrigeration system employing the liquid ring flash expander which is directly coupled to the compressor.
Figure 5:
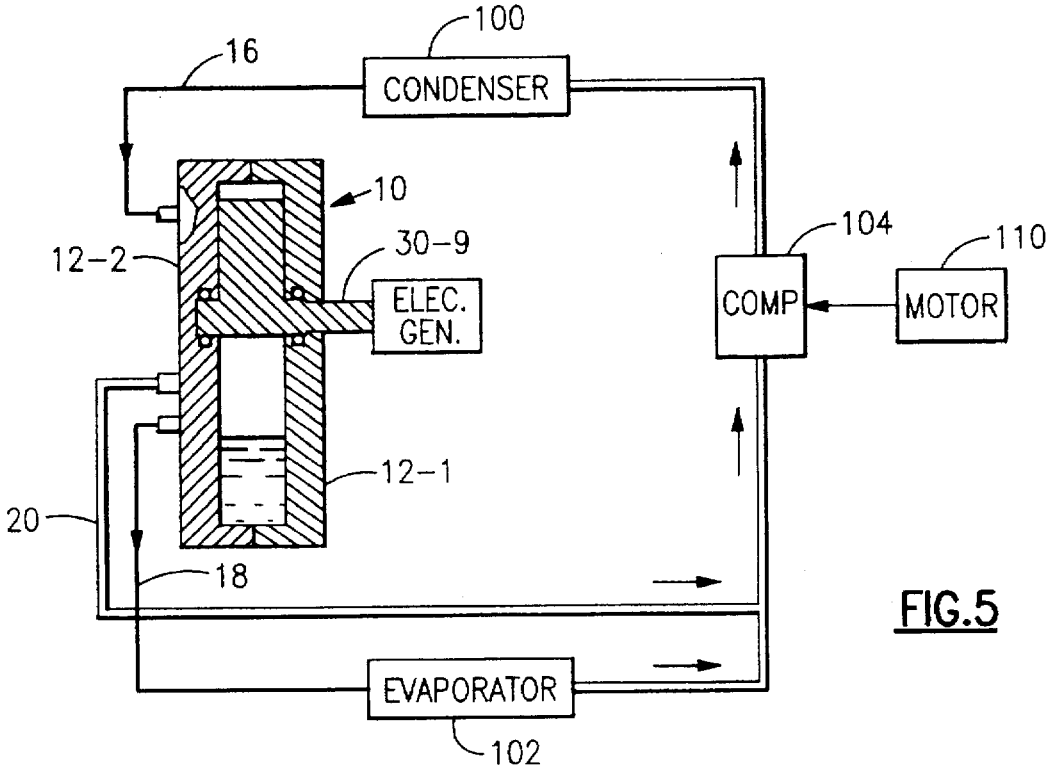
FIG. 5 is a schematic view of a refrigeration system employing the liquid ring flash expander which is coupled to an electrical generator.
Figure 6:
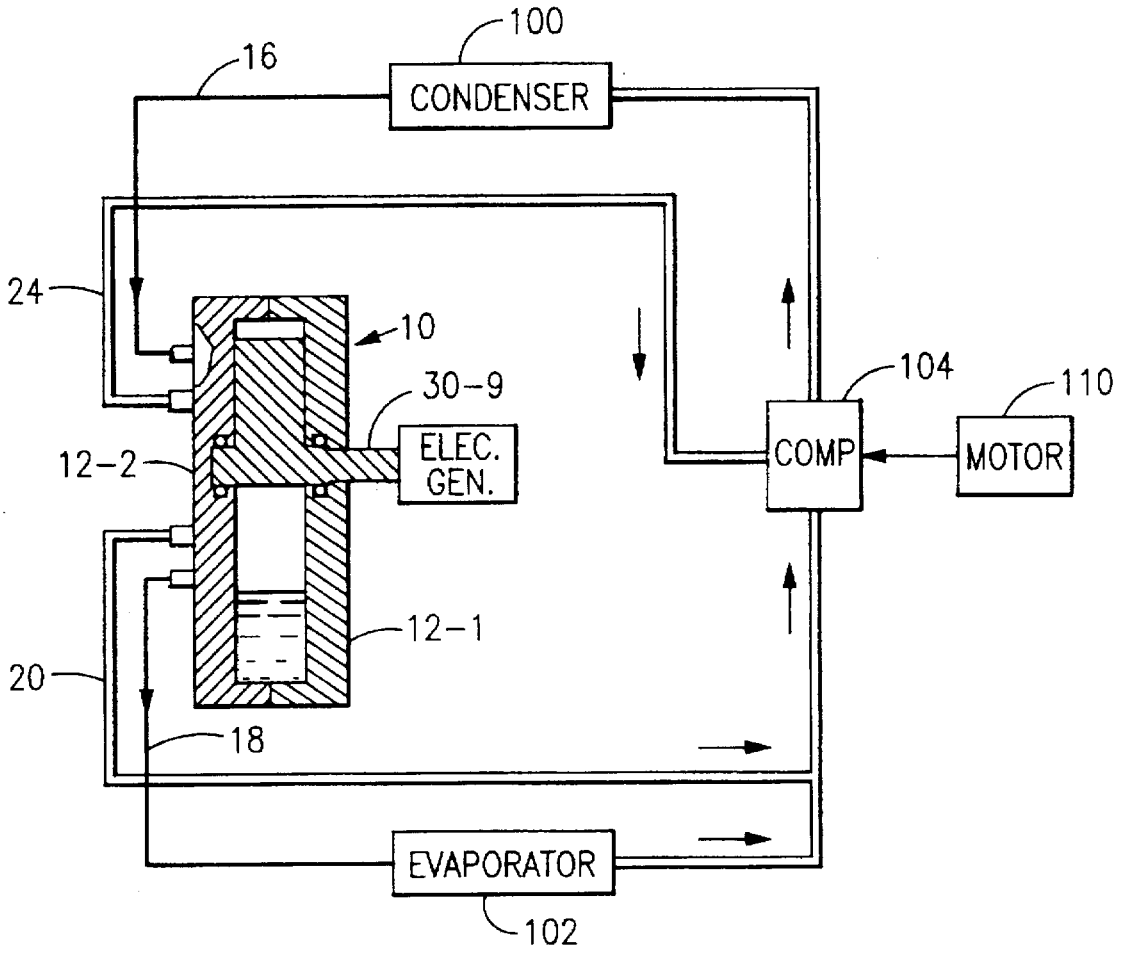
FIG. 6 a schematic view of a refrigeration system employing the liquid ring flash expander which is functioning as an economizer and which is coupled to an electrical generator.

In the Figures, the numeral 10 generally designates the liquid ring flash expander of the present invention. Expander 10 includes a casing 12 made up of members 12-1 and 12-2 which define a cylindrical chamber 14 having an axis B—B. Line 16 is in fluid communication with a condenser 100 of a refrigeration system, as illustrated in FIGS. 4–6, and supplies liquid refrigerant to chamber 14 via port 16-1. Line 18 receives liquid refrigerant from chamber 14 via port 18-1 and delivers it to the evaporator 102 of a refrigeration system. Line 20 receives gaseous refrigerant from chamber 14 via port 20-1 and delivers it to either the evaporator 102 or to compressor 104 depending upon the configuration of the refrigeration system, but all of FIGS. 4–6 show delivery to compressor 104. If present and operative, line 22, or line 24 which is generally alternative, receives gaseous refrigerant from chamber 14 via port 22-1 or port 24-1, respectively, which are circumferentially spaced from port 20-1, and delivers it to multi-stage compressor 104 as economizer gas as shown in FIG. 6.

Vaned rotor 30 is located in chamber 14 so as to be rotatable about axis A—A which is eccentric with respect to axis B—B of cylindrical chamber 14. Accordingly, the tips of vanes 30-1 to 30-8 vary in their distance from the wall of chamber 14 but in each instance there is enough liquid and sufficient clearance to support a liquid ring. Shaft or axle 30-9 of vaned rotor 30 is suitably supported in casing 12 and, if desired, may have associated therewith suitable structure to permit rotation of rotor 30 in a single direction. Generally, the direction of rotation would be immaterial if only ports 16-1, 18-1 and 20-1 were present and roughly located along a diameter with respect to axis A—A. However, further profiling of the rotor for aerodynamic reasons, for example, could result in a preferential direction of rotation.

Adjacent vanes of rotor 30 define cells. For example, vanes 30-1 and 30-2 and casing 12 define a cell which is in communication with the condenser 100 via port 16-1. Rotation of rotor 30 creates a centrifugal force tending to move the liquid refrigerant radially outward into the liquid ring. The increase in vapor volume when rotating will reduce pressure such that flashing of the liquid (evaporation of some of the liquid) occurs which tends to cool the remaining liquid refrigerant in the cell. As a result, the cells contain gaseous refrigerant 50 in the region near the axis of rotation, A—A, of lower pressure when going from inlet to discharge and liquid refrigerant 50-1 of successively lower temperature. This is facilitated by the increasing radial distance of the vane tips to the wall of the casing 12 which tends to lower the pressure in the cell and thereby increases the flashing.

As a cell rotates from the illustrated position of the cell defined by vanes 30-1 and 30-2 to the illustrated position of the cell defined by vanes 30-4 and 30-5, the flashing increases due to the reducing pressure and the gaseous and subcooled liquid refrigerant are separated due to centrifugal forces. As the cell moves from the illustrated position of the cell defined by vanes 30-4 and 30-5 to the illustrated position of the cell defined by vanes 30-5 and 30-6, the separated gaseous refrigerant 50 in the cell comes into communication with port 20-1 and the gaseous refrigerant passes from the cell via port 20-1 and is supplied to either the evaporator 102 or compressor 104 depending upon the configuration of the refrigeration system, but FIGS. 4–6 show supplying to compressor 104. Similarly the subcooled liquid refrigerant 50-1 comes into communication with port 18-1 and the subcooled liquid refrigerant passes from the cell via port 20-1 and is supplied to the evaporator 102. The removal of some of the gaseous refrigerant 50 and some of the subcooled liquid refrigerant 50-1 from the cell together with the centrifugal forces produces further outgasing. As the cell moves to the illustrated position of the cell defined by vanes 30-3 and 30-4 or to the illustrated position of the cell defined by vanes 30-7 and 30-8, gaseous refrigerant is available at intermediate pressure and may be dram off via port 22-1 or port 24-1, respectively, which are circumferentially located between ports 16-1 and 20-1, if present, and supplied to the compressor 104 at an intermediate pressure level, as illustrated in FIG. 6, thus enabling an economizer cycle without the need for a separate economizer vessel depending upon the configuration of the refrigeration system. As the cell moves toward the illustrated position of the cell defined by vanes 30-1 and 30-2, the pressure in the cell increases due to a reduced radial distance from the wall of casing 12 but the gaseous and subcooled refrigerant remain separated.

The ports 18-1 and 20-1 will, generally, be spaced on the order of 180° from port 16-1 but this can be changed depending upon whether or not port 22 or 24 is present, the desired temperature, pressure, sequence and amount of refrigerant being drawn off through the various ports, and due to the angular spacing of adjacent vanes as different numbers of vanes are used. Accordingly, port 16-1 can be spaced 90° to 270° from ports 18-1 and 20-1 but a spacing near 180° is preferred. Port 22-1 or 24-1, as the case may be, may be as close to ports 16-1, 18-1 and 20-1 as permitted by the angular spacing of the vanes to define a cell and can be as close to port 16-1 as the angular spacing of cell however a mid-location of about 90° is preferred with a separation of about 40° to 140° being possible. The ports 18-1, 20-1, 22-1 and 24-1 must be radially located such that they can only receive liquid in the case of port 18-1 and gaseous refrigerant in the case of ports 20-1, 22-1 and 24-1. Accordingly, port 18-1 is located at least half the radial distance between axis A—A and the tips of the vanes from axis A—A. A greater radial distance is preferred but it must be less than the radial extent of the vanes.

From the foregoing description it should be clear that ports 16-1, 18-1 and 20-1 are always employed and are connected, respectively, to the condenser 100, the evaporator 102 and compressor 104. Ports 22-1 and 24-1 are generally alternative and would only be used for economizer operation whereas port 20-1 could alternatively be used for economizer flow alone or in combination with either one of ports 22-1 and 24-1 if plural economizer flows are desired. In generally, the interface 50-2 between gaseous refrigerant 50 and liquid refrigerant 50-1 is, nominally, the same distance from the outer wall of chamber 14 absent the effects of supplying liquid refrigerant to the cells and withdrawing liquid and gaseous refrigerant from the cells.

Because the expansion of refrigerant causes rotor 30, and thereby shaft 30-9, to rotate, liquid ring expander 10 can be employed in a number of refrigeration circuit configurations of which FIGS. 4–6 are exemplary. In the FIG. 4 configuration liquid ring expander functions as the expansion device in a refrigeration circuit. The power available due to the rotation of rotor 30 and shaft 30-9 is used to supplement the driving force supplied to compressor 104 by motor 110 by connecting shaft 30-9 to the drive train (not illustrated) of compressor 104. The FIG. 5 configuration differs from the FIG. 4 configuration in that shaft 30-9 drives electrical generator 120 rather than being directly connected to compressor 104. The output of electrical generator can supplement the electrical power supplied to motor 110. The FIG. 6 configuration differs from the FIG. 5 configuration in adding an economizer operation and in requiring that compressor 104 is a multi-stage compressor, as is required for economizer operation. As noted above, line 20 could provide the sole economizer flow or in conjunction with line 22 or 24 where multi-stage economizer operation is required or desired. The FIG. 6 configuration, however, has a single economizer flow to multi-stage compressor 104 and that is supplied via line 24, as illustrated.

Although preferred embodiments of the present invention have been illustrated and described, other changes will occur to those skilled in the art. It is therefore intended that the scope of the present invention is to be limited only by the scope of the appended claims.

What is claimed is:

1. A liquid ring flash expander comprising:

a casing;

a cylindrical chamber within said casing and having a centrally located axis;

a vaned rotor located in said chamber and having an axis of rotation spaced from said centrally located axis;

said vaned rotor having a plurality of vanes having tips spaced from said chamber varying distances due to said spacing of said axes;

a first port in fluid communication with said chamber and located radially inward of said tips of said vanes;

a second port in fluid communication with said chamber, circumferentially spaced from said first port, located radially inward of said tips of said vanes and radially outward of said axis of rotation a distance at least equal to half of the distance between said tips and said axis of rotation;

a third port in fluid communication with said chamber, circumferentially spaced from said first port and located radially inward of said second port;

adjacent vanes of said plurality of vanes define cells which rotate with said rotor and move into and out of registration with said first, second and third ports whereby when liquid refrigerant is supplied to said chamber via said first port into one of said cells, said one cell is subjected to centrifugal forces as said one cell rotates such that flashing occurs producing gaseous refrigerant and cooled liquid refrigerant, said cooled liquid refrigerant passing from said one cell when said one cell comes into registration with said second port and gaseous refrigerant passing from said one cell when said one cell comes into registration with said third port.

2. The expander of claim 1 further including a fourth port in fluid communication with said chamber, circumferentially spaced from said first, second and third ports and located radially inward of said second port.

3. The expander of claim 2 wherein said third and fourth ports are circumferentially spaced at least 40° apart.

4. The expander of claim 2 wherein at least one of said third and fourth ports supplies economizer gas to a multi-stage compressor.

5. The expander of claim 1 wherein said first and second ports are circumferentially spaced between 90° and 270° apart in the direction of rotation of said vaned rotor.

6. The expander of claim 1 wherein said second and third ports communicate with the same one of said cells at the same time.

7. The expander of claim 1 wherein said vaned rotor has a shaft sealingly supported in said casing, extending therefrom and operatively connected for driving an electrical generator.

8. The expander of claim 1 wherein said vaned rotor has a shaft sealingly supported in said casing, extending therefrom and operatively connected for driving a compressor.

* * * * *